US012060094B2

(12) United States Patent
Simkin et al.

(10) Patent No.: US 12,060,094 B2
(45) Date of Patent: Aug. 13, 2024

(54) MANAGING, MONITORING, AND VALIDATING TRAIN CONSISTS

(71) Applicant: Union Pacific Railroad Company, Omaha, NE (US)

(72) Inventors: Daniel Simkin, Westminster, CO (US); Ryan Grudle, Council Bluffs, IA (US); Jeffrey Girbach, Milford, IA (US); Srinivas Chundru, Broomfield, CO (US)

(73) Assignee: Union Pacific Railroad Company, Omaha, NE (US)

( * ) Notice: Subject to any disclaimer, the term of this patent is extended or adjusted under 35 U.S.C. 154(b) by 188 days.

(21) Appl. No.: 17/587,617

(22) Filed: Jan. 28, 2022

(65) Prior Publication Data

US 2022/0242470 A1 Aug. 4, 2022

Related U.S. Application Data

(60) Provisional application No. 63/143,288, filed on Jan. 29, 2021.

(51) Int. Cl.
*B61L 27/60* (2022.01)

(52) U.S. Cl.
CPC ..... *B61L 27/60* (2022.01)

(58) Field of Classification Search
CPC ..... B61L 27/40; B61L 27/60; B61L 27/57
See application file for complete search history.

(56) References Cited

U.S. PATENT DOCUMENTS

| | | | | |
|---|---|---|---|---|
| 4,041,283 | A * | 8/1977 | Mosier | G09B 9/04 246/167 R |
| 9,731,735 | B1 * | 8/2017 | Nishinaga | B61L 15/0072 |
| 11,453,421 | B2 * | 9/2022 | Howard | B61L 27/60 |
| 2009/0187291 | A1 * | 7/2009 | Daum | B61L 15/0058 701/19 |
| 2009/0299555 | A1 * | 12/2009 | Houpt | B61L 27/16 701/19 |

(Continued)

FOREIGN PATENT DOCUMENTS

| | | | |
|---|---|---|---|
| KR | 20090026887 | A | 3/2009 |
| KR | 20120020442 | A | 3/2012 |

(Continued)

OTHER PUBLICATIONS

International Search Report and Written Opinion for Application No. PCT/US2022/014339, dated May 25, 2022.

*Primary Examiner* — Long T Tran
(74) *Attorney, Agent, or Firm* — Daniel J. Honz; Advent, LLP

(57) ABSTRACT

Systems and methods for train consist management are provided. In an aspect, a method includes, but is not limited to, designing a train consist; analyzing the train consist with a physics-based dynamic force model to determine whether the train consist would experience at least one of in-train force imbalances or lateral force imbalances indicative of at least one of a component malfunction or a derailment scenario for a proposed train route; and validating the train consist when it is determined that the train consist would not experience in-train force imbalances indicative of at least one of a component malfunction or a derailment scenario for the proposed train route.

14 Claims, 3 Drawing Sheets

(56) References Cited

U.S. PATENT DOCUMENTS

| | | | | |
|---|---|---|---|---|
| 2010/0023190 | A1* | 1/2010 | Kumar | B61L 27/53 701/20 |
| 2018/0371699 | A1* | 12/2018 | Baker | B61L 23/047 |
| 2019/0225250 | A1 | 7/2019 | Esprey et al. | |
| 2021/0107539 | A1* | 4/2021 | Howard | G06F 18/241 |
| 2021/0107545 | A1* | 4/2021 | Howard | B61L 27/16 |
| 2022/0194446 | A1* | 6/2022 | Akif | B61L 27/70 |

FOREIGN PATENT DOCUMENTS

| | | | |
|---|---|---|---|
| KR | 101299526 | B1 | 8/2013 |
| KR | 102203412 | B1 | 1/2021 |

* cited by examiner

MANAGING, MONITORING, AND VALIDATING TRAIN CONSISTS

CROSS-REFERENCE TO RELATED APPLICATIONS

The present application claims the benefit of 35 U.S.C. § 119(e) of U.S. Provisional Application Ser. No. 63/143,288, filed Jan. 29, 2021, and titled "MANAGING, MONITORING, AND VALIDATING TRAIN CONSISTS." U.S. Provisional Application Ser. No. 63/143,288 is herein incorporated by reference in its entirety.

BACKGROUND

Train component failures or malfunctions during the completion of a trip are problems for train operators and companies. These failures or malfunctions cause time delays, financial costs, and may even result in train car derailments that put people and cargo in danger. Changes in a train consist during travel of the train along a route can increase a risk for a failure or malfunction due to changed physical characteristics of the train as physical loads are added or removed or the train consist, train cars are added, removed, or reordered, or other changes occur. Travel routes can also affect the physical forces exerted on a train, where differing consists may experience differing physical forces over the course of travel.

DRAWINGS

The Detailed Description is described with reference to the accompanying figures. The use of the same reference numbers in different instances in the description and the figures may indicate similar or identical items.

DETAILED DESCRIPTION

Figure 1:
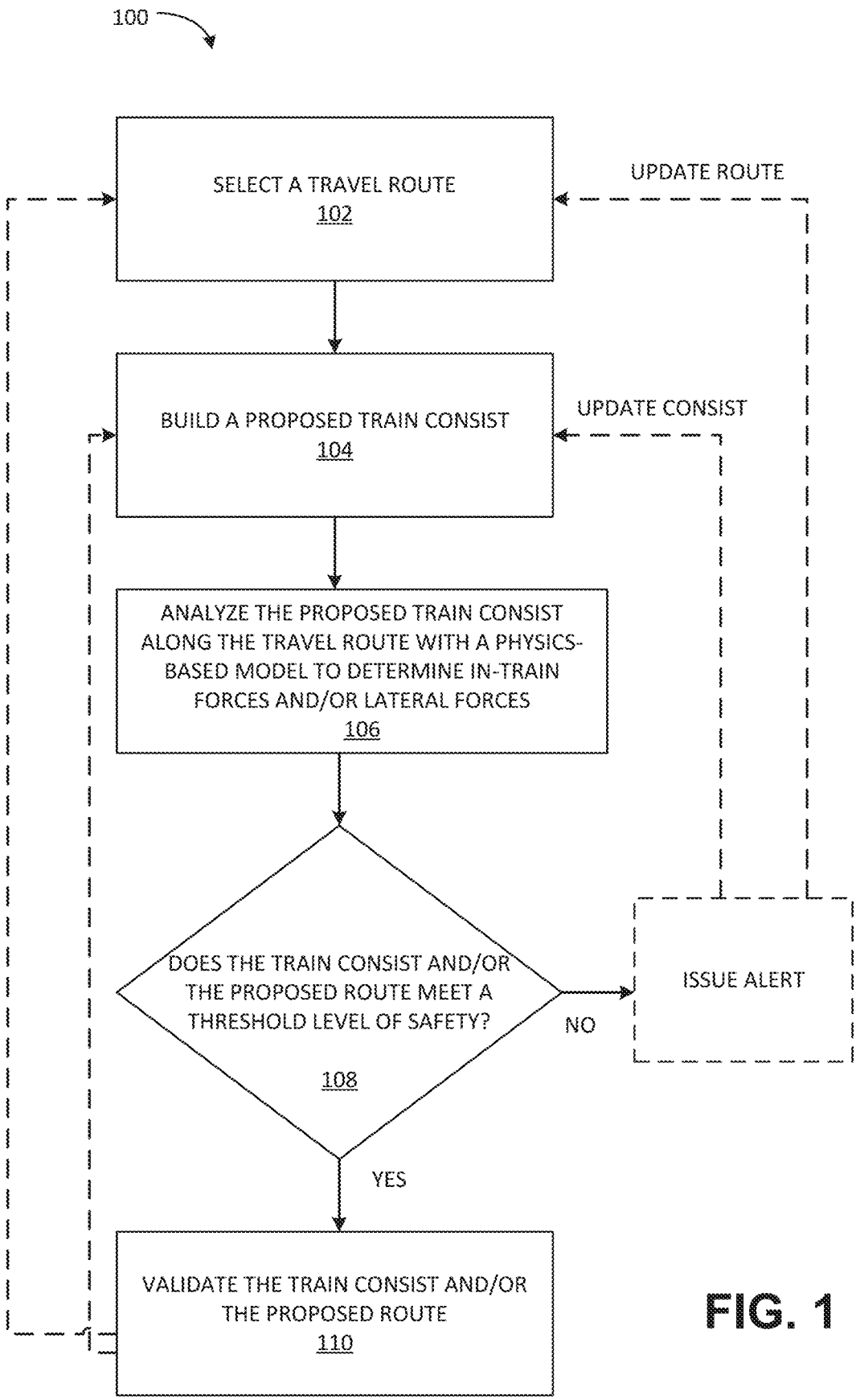
FIG. 1 is a flowchart of a method of planning and validating a train consist for a given travel route in accordance with example embodiments of the present disclosure.

Although the subject matter has been described in language specific to structural features and/or process operations, it is to be understood that the subject matter defined in the appended claims is not necessarily limited to the specific features or acts described above. Rather, the specific features and acts described above are disclosed as example forms of implementing the claims.

OVERVIEW

A train consist refers to a group of rail vehicles such as railcars and locomotives that make up a train. The train consist can influence the physical forces exerted on the train during travel on the rails towards a destination. For instance, the individualized railcars and locomotives can experience in-train forces that influence whether coupling devices that connect one railcar to another can maintain the physical connection or whether the connection breaks (e.g., a "break-in-two" event). The positioning and amount of railcars and locomotives influence the forces experienced by the railcars, where such forces may not be evenly distributed along the train. For instance, connections between heavier railcars can experience higher in-train forces due to changes in grade of the track than connections between lighter railcars.

Changes in grade of the rail track can also affect in-train forces, where changes in speed of one railcar relative to another due to transitions in rail track grade can cause individual railcars to tend to move away from each other (e.g., where a front car moves faster relative to a rear car) or to move closer to each other (e.g., where a rear car moves faster relative to a front car). These in-train forces can result in slack in the train running in or out, which can stress connections between railcars, potentially causing mechanical failures or derailment scenarios. Additionally, individualized railcars and locomotives experience lateral forces and lateral over vertical forces (L/V) through contact between the wheels of the railway vehicles and the track. As the lateral forces or lateral over vertical forces increase, the stability of the railway vehicle can decrease, which can result in train component malfunctions or failures, such as draw bar failures, knuckle failures, wheel climbing over the track, etc. These in train component malfunctions or failures can cause undesirables events or scenarios that can put people and cargo in danger, such as break-in-twos, stalls, and derailment.

Attempting to forecast potential train component malfunctions or failures can become problematic, particularly when relying on static modeling that simulates a train consist as a rigid structure without accounting for various in-train forces or for speed differences between individual railway vehicles during rail track grade transitions. Moreover, the particular travel route can greatly affect in-train forces, lateral forces, and lateral over vertical forces due to differing railway track curves, speeds, grades, detours, stops, and the like. Changes in the train consist over a travel route, such as through adding, removing, or rearranging railway vehicles in the consist, adding, removing, or rearranging loads in the consist, or other changes can increase the challenge of forecasting potential train component malfunctions or failures by incorporating multiple consists in a single travel route.

Accordingly, the present disclosure is directed, at least in part, to systems and methods of train consist management that include planning, analyzing, validating, and monitoring a train consist makeup or build. In an aspect, validation of a train consist involves determining whether a train consist modeled with historical railway vehicle data can complete a journey from a selected departure location to a selected destination location without experiencing physical force imbalances that would put the train at risk for train component malfunction or failure. In implementations, the systems and methods determine whether a train consist exceeds a predetermined force threshold through analysis of the dynamics and characteristics of the train consist along the travel route, modeled using historic data of train consist build elements (e.g., recorded by a Train Management System (TMS)) and track information along the travel route. In aspects, the systems and methods determine one or more of in-train forces and lateral over vertical force ratios (L/V) for a given consist. In implementations, a physics-based dynamic force model is utilized to analyze simulated outcomes of a given consist over a given travel route for transient forces that result in a train as the slack in the train runs in or out. For example, the physics-based dynamic force model can account for movement between the individual railway vehicles of a train relative to each other, rather than simulate the entire selected train consist as a rigid body.

In an aspect of the disclosure, a method of managing a train consist includes selecting an anticipated route, entering a consist makeup to be validated, determining a minimum safety margin, and validating the consist makeup based on whether the consist makeup meets or exceeds the minimum safety margin. The method of managing a train consist also includes notifying users if it is safe to proceed with the train route or if it is necessary to modify the train consist, the operation of the train consist, or the proposed route for a given train consist. In implementations, if the particular train consist does not meet or exceed the minimum safety margin, the component or components of the train consist that are predicted to experience a physical force imbalance are identified and reported. A user can then modify the train consist to determine whether the modified train consist would meet the minimum safety margin, such as through a reduction in the length of the train, a rearrangement of the empty/loaded railway vehicles, or the like. Alternatively or additionally, the operation of the train consist can be modified, such as through a reduction in maximum speed of the train, average speed of the train, or the like.

Validating the safety margin reduces the likelihood of exceeding safe physical in-train forces, lateral over vertical force ratios (L/V), or combinations thereof, that may cause train component malfunction resulting in break-in-twos, stalls, and derailment scenarios. In implementations, several iterations of validating a train consist may be utilized to reach the minimum safety margin to provide a validated or "safe to proceed" notification. The method of managing a train consist can include analyzing asset utilization by comparing outcomes for various consists for a given route of transportation.

In an aspect of the present disclosure, the method of managing a train consist includes real-time, active monitoring of the train consist during multiple points throughout the travel route of the train. For instance, train consists can change when the train stops at different railyards across the selected route. These train consist changes are also referred to as work events. The method of managing a train consist can include automatically monitoring and re-validating the train consist following a work event or after every work event. This re-validating step reduces the likelihood of inadvertent consist placements that may result in decreased train performances, safety thresholds, or the like, after the train has already started its journey or after the train has been previously validated for a particular route. Alerts are provided to an operating team or communication system if any work events would cause in-train force issues, lateral force issues, or the like, that would preclude re-validation of the altered consist for the travel route. Changes to the altered consist can be made prior to departure of the altered consist responsive to work events that are determined to fall below a minimum safety standard. Methods according to the present disclosure can use computational analysis, railroad geographic information system (GIS) track data, and real-time locomotive event recorder data to expand diagnostic analysis of railroad systems into predictive and prescriptive tools.

Example Implementations

Figure 2:
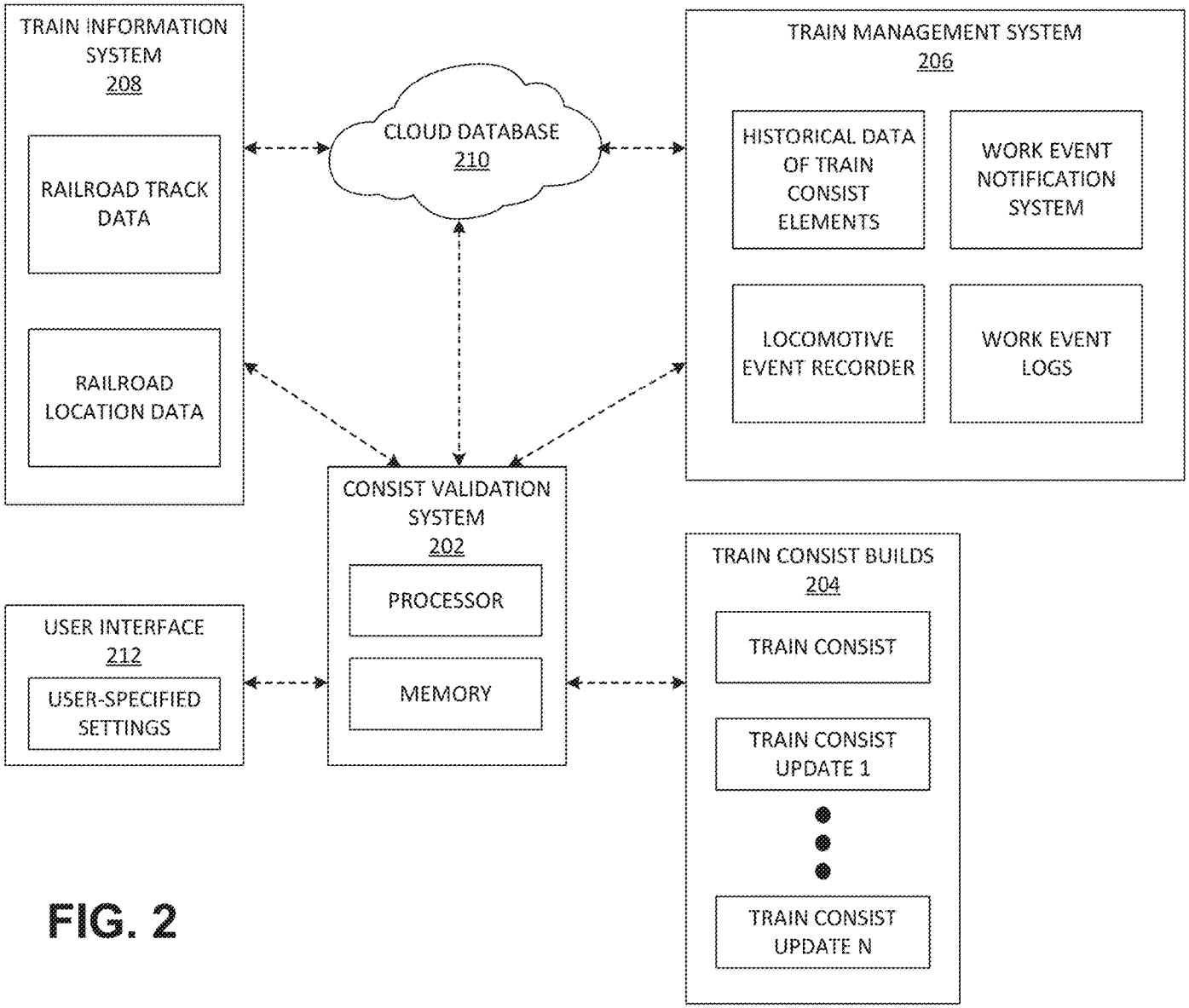
FIG. 2 is a schematic diagram of a system for planning and validating a train consist in accordance with example embodiments of the present disclosure.

Referring to FIGS. 1 and 2, an exemplary flowchart illustrating a method 100 for planning and managing a train consist is shown in FIG. 1 and a system 200 for planning and validating a train consist is shown in FIG. 2. As illustrated, the method 100 generally includes selecting a travel route 102, designing a train consist build or train consist 104, running a simulation of the train consist build along the selected anticipated route 106, checking if the simulation meets a minimum safety margin 108, and validating that the train consist build meets the minimum safety margin necessary to run the anticipated route 110. If the safety margin calculated during the simulation is below the required minimum and the train build consist is forecasted to have component malfunctions or physical force imbalances, the user is notified and one or more new simulations having a different train consist build can be executed, or recommendations for differing handling conditions for the train consist can be provided, or combinations thereof.

The system 200 is shown in FIG. 2 in accordance with example embodiments of the present disclosure. The system 200 generally includes a consist validation system 202 having a computer processor configured to generate one or more train consist builds 204 for analysis with a physics-based dynamic force model stored in computer memory or otherwise accessible by the consist validation system. The consist validation system 202 is communicatively coupled with a train management system 206 and a train information system 208, either directly, through a cloud database 210, or combinations thereof. For example, one or more of the consist validation system 202, the train management system 206, and the train information system 208 can be stored on the cloud database 210 for access to remote portions of the system 200. Alternatively, each of the portions of the system 200 can be integrated into a joint computing system (e.g., co-located). The train management system 206 stores or otherwise provides access to information associated with one or more of train consist elements (e.g., data of physical characteristics of train elements), current and past work events associated with trains on the track, real-time or historical train information (e.g., via a locomotive event recorder), and the like, for the consist validation system 202. The train information system 208 stores or otherwise provides access to information associated with railroad tracks, geographical data for the railroad tracks, and the like, for example to provide geographic-based track data associated with the selected travel route.

The system 200 can receive user input for various features, operations, and thresholds to influence operation of the consist validation system 202. For example, a user can introduce user-specified settings to the system 200 through a user interface 212 that is communicatively coupled with the consist validation system 202. For instance, in implementations, the user interface 212 is associated with a mobile computing device (e.g., smart phone, tablet, or the like), computer, or other device that is communicatively coupled to the consist validation system 202 through the cloud database 210, directly with the consist validation system 202, or combinations thereof. The user-specified settings can include, but are not limited to, elements of the train consist, the travel route of the train consist, specifics of operation of the train (e.g., maximum speed of the train, speed restrictions, wind conditions along the selected travel route, stops along the selected travel route, grade/curve information to deviate from received track data, work events (e.g., setouts, pickups, etc.), train emergency scenarios (e.g., a particular car in the consist catches an air hose at a crossing at a particular mile marker), or the like), and combinations thereof.

Selecting a travel route 102 can include choosing the route along which a proposed train consist will travel in order for the consist validation system 202 to determine whether the proposed train consist will experience any physical force imbalances during travel along the selected travel route. In implementations, information from the selected travel route is accessed by the consist validation system 202 through communication with the train information system 208 (e.g., a railroad-specific track database). For example, the information can include, but is not limited to, geographical location of railway track curves, detours, stops, sideways, speed limits, grades, distance traveled over the route, and the like. The consist validation system 202 can analyze the track information from the train information system 208 to provide force analysis of the selected train consist with respect to the actual physical conditions of the railway track along the selected travel route using the physics-based dynamic force model.

The travel route can be selected according to one or more options. In one implementation, the user selects a departure location and a destination location (e.g., via the user interface 212) for input into the consist validation system 202. The consist validation system 202 then accesses the train information system 208 for potential routes of track that connect the selected departure location and the selected destination location. The consist validation system 202 can then utilize a routing algorithm to compare and rank various routes that connect the selected departure location and the selected destination location to provide a recommendation for the best route according to one or more categories (e.g., the most fuel efficient route, the fastest duration route, the shortest distance route, etc.). For example, the routing algorithm can review and rank routes according to distance or time spent on sidings, main tracks, rail yards, and the like to recommend a route based on the rank. In another implementation, the user can chart the entire travel route or portions thereof, or a modification of a route generated by the routing algorithm, (e.g., via the user interface 212) for input into the consist validation system 202.

Designing a train consist 104 can include designing a virtual train consist for analysis by the consist validation system 202 through one or more of selecting an existing train consist (e.g., of a train currently on track), a historical consist (e.g., of a train previously on track), or building a new train consist. For instance, a train consist can be modeled after a physical train consist that is currently deployed on the track to determine whether the train can complete the remainder of the travel route without physical force imbalances or whether changes or modifications to the train consist would be expected to cause physical force imbalances). Alternatively or additionally, the train consist can be modeled on an ad hoc basis to simulate a train, such as to schedule a train consist for a future travel route. For example, the consist validation system 202 can access data corresponding to physical characteristics of the train components that make up the selected train consist, which can be a historical train build, a modified train build, or built by individually selecting components from a list of train components to create a new train consist. The list of train components can be limited to existing train components that have corresponding physical characteristics available to the system 200. The physical characteristics can include, but are not limited to, weight of the railcar, physical dimensions or size of the railcar, position of the railcar in the consist, and the like.

The data corresponding to physical characteristics of the train components can be accessed by the consist validation system 202 through communication with the train management system 206 that stores information about each of the components of the train consist (e.g., an UMLER™ railway equipment database available from Railinc in Cary, North Carolina). The physical characteristics data can be utilized by the consist validation system 202 with the track information received from the train information system 208 to provide physics-based dynamic force modeling of the selected train consist as the train is modeled to progress along the selected route. For existing trains on track, the consist validation system 202 can receive a data package from the train management system 206 which identifies the particular components of the existing train consist and provides the details of the scheduled route for that train. The consist validation system 202 can then receive from the train management system 206 a data package with the details of the particular components (e.g., physical characteristics of the railcars, etc.) that make up the existing train consist for modeling by the consist validation system 202. In implementations, the consist validation system 202 can modify the scheduled route for the existing train or provide recommendations for changes in the operation of the existing train, such as reductions in speed.

The consist validation system 202 can account for changes or proposed changes in a train consist during travel along the selected travel route. For example, train consists can change when the train stops at different railyards across the selected route, such as by adding or removing train cars from the consist, shifting the ordering of train cars of the consist, adding or removing loads from the train cars, or the like. These train consist changes are also referred to as work events. Designing a train consist 104 can include receiving an updated train consist resulting from a work order. For example, the consist validation system 202 can receive an indication from the train management system 206 that a work order has occurred for a given train and the consist validation system 202 can receive a data package containing information associated with the updated consist, such as the particular elements and their associated arrangement following the work order. The consist validation system 202 can then validate or re-validate the updated train consist prior to the train leaving the railyard that resulted in the work order, such as to determine whether the updated train consist is expected to result in component malfunctions or physical force imbalances. If the updated consist is expected to result in component malfunctions or physical force imbalances (e.g., the result of block 108 is "No"), the consist validation system 202 can generate an alert and optionally iterate the operation of the updated train consist to determine appropriate speeds for handling the updated train consist at the specific geographical location that results in the high forces, as described herein.

Running a simulation of the train consist build along the selected anticipated route 106 generally includes utilizing the physics-based dynamic force model to calculate one or more of in-train forces, lateral forces, and lateral over vertical force ratios (L/V) for the selected train consist as the selected train consist travels over the selected travel route. The number of elements of the train consist analyzed and the frequency of the calculations along the selected travel route generally depends on the amount of information desired. In implementations, the physics-based dynamic force model calculates the forces experienced by every element in the selected train consist on a continuous basis over the selected travel route. Alternatively, the physics-based dynamic force model can calculate the forces experienced by one or more elements in the selected train consist at certain predefined points along the selected travel route that are expected to result in relatively large forces or force differentials. For example, the predefined points can include, but are not limited to, curves in the track, changes in grade of the track, regions of the track having designated speed limits (e.g., regions of the selected travel route having the fastest speed limit(s)), regions of the track having transitions in speed limit (e.g., from slower to faster, from faster to slower, etc.), or the like. In implementations, a user can set one or more physical features to be analyzed by the physics-based dynamic force model during travel of the selected train consist along the selected travel route. These physical features can include, but are not limited to, stops for the train along the selected travel route, speed restrictions, wind conditions, or the like.

The physics-based dynamic force model can include settings directed to handling of the selected consist, such as to determine whether the train consist can be responsibly handled during the selected travel route to avoid physical force imbalances. For example, the physics-based dynamic force model can include one or more settings that simulate traits of the engineer driving the train modeled by the selected train consist, where such settings can include, but are not limited to, throttle application (e.g., duration of time between throttle notches), acceleration limits, brake application (duration of dynamic brakes), geographical handling restrictions (e.g., maximum speeds or average speeds for grades or grade changes, curves, elevation, etc.), handling adjustments based on in-train forces (e.g., when a draft force is determined to exceed a threshold draft force, prevent throttling to avoid increasing the draft force), look ahead values (e.g., how far ahead the engineer looks to the next train stop), and the like.

In implementations, the system 200 receives data for the selected travel route, such as locations and types of grades and curves, total distance, track speeds, and the like, through communication with the train information system 208 that stores or otherwise provides access to a railroad track database. The location of train stops for a selected train consist can be provided through a railroad train schedule system, such as through communication between the consist validation system 202 and the train management system 206. The system 200 dynamically applies the specific data along the selected travel route to ensure that the selected train consist and its individual elements can be handled responsibly by an engineer to complete the entire selected travel route without physical force imbalances occurring that would put the train at risk of train component malfunction or failure or derailment scenarios. In implementations, the consist validation system 202 is communicatively coupled with additional information sources to provide updated conditions along the selected travel route at the time of the simulation. For example, the consist validation system 202 can receive data associated with weather conditions (e.g., to provide wind conditions affecting the train), dimensional clearance conditions (e.g., whether the train consist can physically traverse the selected path without failing a vertical clearance or width clearance), slow orders or other operational bulletins, or the like.

Checking if the simulation meets a minimum safety margin 108 can include utilizing the physics-based dynamic force model to analyze the forces experienced throughout the train consist during travel along the selected travel route. For instance, the physics-based dynamic force model can determine whether a portion or portions of the train consist exceeds one or more predetermined force thresholds through analysis of the dynamics and characteristics of the train consist along the travel route. In implementations, the predetermined force thresholds, railway conditions along the travel route, or other factors, or combinations thereof, include user-specified values, such as for analysis of existing trains on track by the consist validation system 202. For example, the user can specify (e.g., via the user interface 212) force thresholds including, but not limited to, buff thresholds, draft thresholds, lateral thresholds, stall thresholds, or the like. For instance, draft forces can provide an indication that a coupler between railcars might be at risk for failing, buff forces can provide an indication that the train will tend to accordion (e.g., a risk for derailment), lateral forces can provide an indication that a train car is at risk for tipping over, and the like. Since the force model is a dynamic model, the method 100 can monitor in-train forces as the train is modeled to travel along the travel route. For example, if the in-train force exceeds a threshold value at a particular geographical location, the train can be at risk for a coupler between railcars breaking at that point along the travel path.

The consist validation system 202 can generate one or more alerts if it is determined that the selected train consist is at risk for a component malfunction or physical force imbalance. For example, the consist validation system 202 can compare the in-train forces experienced by the selected train consist over the selected route (e.g., simulated by the physics-based dynamic force model) to the predetermined force thresholds to determine whether the selected train consist meets a minimum safety margin. The alert can be generated for the user to review locally, can be communicated to the train management system 206 or another railroad communications interface (e.g., where the alert can then be sent to train communication hubs, train safety teams, train operators, or the like, to adjust the train consist or operation thereof accordingly), or combinations thereof. Alternatively or additionally, the alert can be transmitted directly to the train operator or crew on the train (e.g., when the consist is an existing train on the tracks).

In implementations, if a high force event is identified by the consist validation system 202 for a selected train consist, the consist validation system 202 can perform iterative analyses of the same train consist, but with differing operation parameters to determine if a safe operation threshold can be reached. For example, if the consist validation system 202 identifies in a first simulation an in-train force that exceeds predetermined force thresholds at a specific geographic location along the selected travel route, the consist validation system 202 can lower the operation speed in subsequent simulation(s) to determine a speed, if any, that the in-train force at the particular geographic location is reduced below the predetermined force thresholds. The updated operation conditions can then be reported out with the alert to provide an indication of a potential problem with the selected consist and a potential solution to avoid the potential problem. For example, the consist validation system 202 can generate an alert that is communicated to the train management system 206 with a recommendation to operate the train at a certain speed or beneath a certain speed between specific geographical mile markers along the travel route.

In implementations, a minimum safety margin for the selected train consist can be determined by checking that the train consist is built using Train Management System (TMS) rules and that the train consist maintains in-train forces, lateral forces, lateral over vertical force ratios (L/V), or the like, or combinations thereof, that avoid derailment, decoupling, or other structure-based issues during travel along the selected travel route. The method 100 of managing a train consist build may include executing multiple iterations of train consist or selecting a different travel route if the train consist are built within compliance of TMS rules but the simulations still do not meet the minimum safety margin. Alternatively or additionally, multiple consist configurations can be simulated even when a given consist meets a minimum safety margin or an aspect of a minimum safety margin, such as when a different margin of safety is analyzed.

Although the method of FIG. 1 is described in accordance with a particular sequence of steps, one skilled in the art can recognize that the method of the present invention should not be limited to the described sequence.

In one embodiment of the present disclosure, the method 100 may include taking different train consist builds from a railroad's TMS and running simulations of the train consist builds across real routes to compare outcomes. The different simulations let users compare and change a variety of operational parameters including, but not limited to, maximum speed, average speed, distance traveled, run time, train length, train weight, weight distribution, power distribution (e.g., locomotive placement location(s) in the consist), location along route, and the like. Additionally, the method 100 of managing a train consist may include analyzing asset utilization which may include analyzing changes to the train length, car placement and operational speeds of the simulation to suggest different options available for the train consist build. In implementations, the consist validation system 202 provides an output of one or more of an expected run time for the selected train consist to complete the selected travel route, an expected amount of fuel utilized to complete the selected route, or the like, which can aid in determining financial metrics for the route.

In implementations, the method 100 of managing a train consist build includes utilizing an active simulation monitor to actively monitors train consists during progress of the train over the selected route, such as to analyze real-time changes to the train consist build (e.g., work events) after the start of the selected route. The active simulation monitor provides a focus on reduced in-train forces, managing lateral over vertical force ratios (L/V), and reduced derailment by utilizing point-to-point scenario creation throughout the duration of the train run. The method 100 of managing a train consist build can a step of sending alerts to the operating team about in-train force issues, lateral force issues, or combinations thereof, in real-time, such as following a work event providing one or more changes to the train consist during a travel route. For additional analysis, external data points can also be integrated, such as dimensional clearance, weather, track adhesion, wind, bulletins, and slow orders. These external datasets may be obtained through on-board sensors, off-board sensors, wireless databases, etc. and may include historical and/or real-time data points. The method 100 can also include embedding and then utilizing historical and institutional knowledge in analysis to improve financial performance of train builds and runs.

Figure 3:
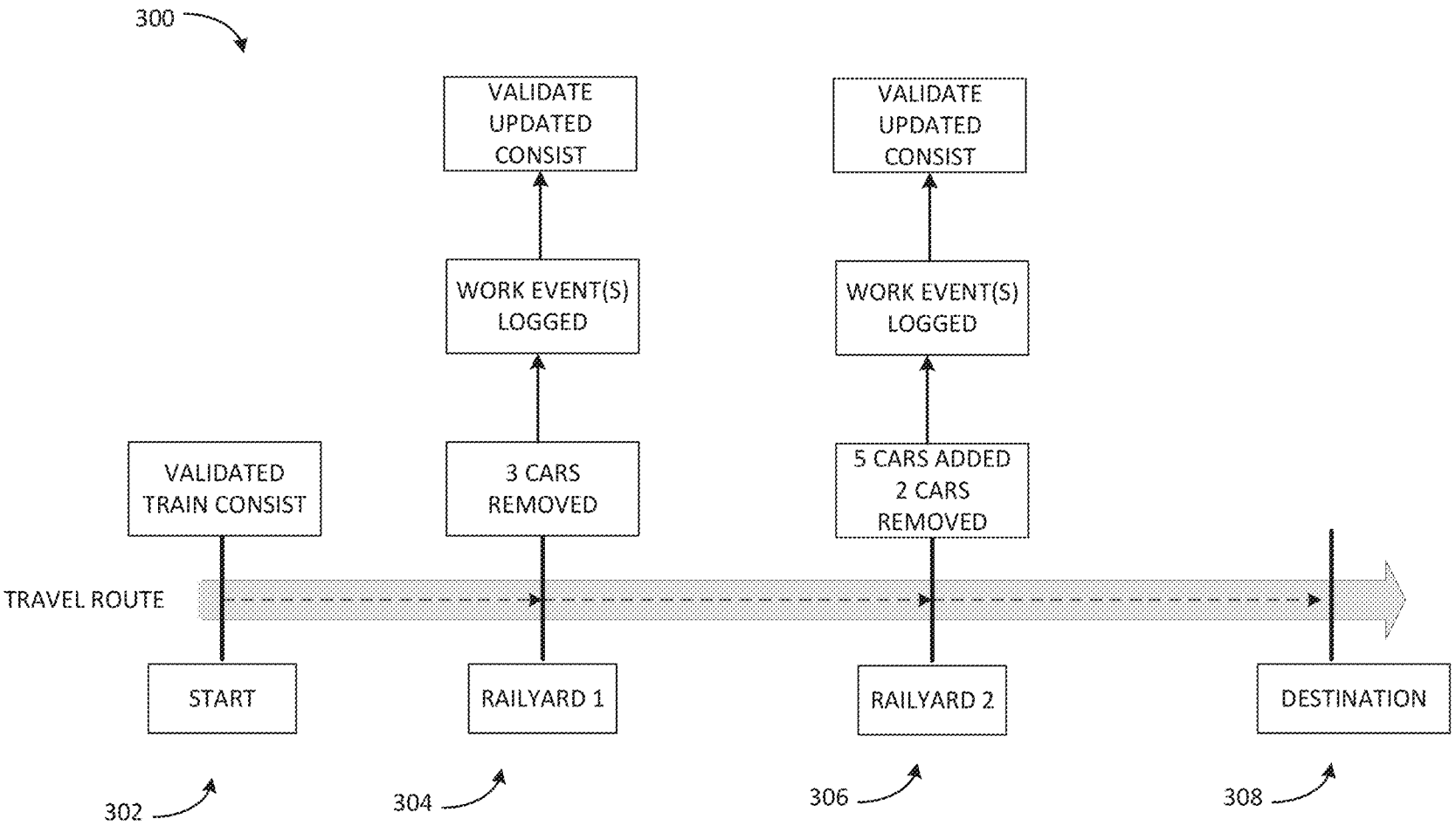
FIG. 3 is a flowchart of a method of monitoring a train consist and re-validating the train consist following a plurality of work events in accordance with example embodiments of the present disclosure.

As described herein, the method 100 of managing a train consist build may include monitoring changes made to the train consist build after the start of the journey. For example, as shown in FIG. 3, a previously validated train consist build 300 leaves the starting location 302 and reaches a first railyard stop 304. During its first railyard stop 304, three cars are removed from the locomotive and a work event is communicated to a train management system. Upon receipt of the work event, the train consist build is automatically re-validated (e.g., following the steps shown in FIG. 1) before continuing the predetermined route. For example, alteration of the train consist is logged by the train management system 206, where a work event regarding the change is automatically generated and communicated to the consist validation system 202. Following the work event, the updated consist is analyzed by the consist validation system 202 utilizing physics-based dynamic force model simulations to re-validate the updated consist or indicate one or more potential failures in one or more components of the updated consist (e.g., one or more linkages expected to fail, derailment incident likely to occur, etc.). During a second railyard stop 306, two cars are removed and five cars are added to the train consist build. Once again, the train consist build is re-validated using the new parameters of the design following receipt of the second work event before leaving the second railyard stop 306 to reach the final destination 308. One skilled in the art can recognize that the example presented is not limiting to different situations where the method of managing a train consist may be employed.

The system 200, including some or all of its components, can operate under computer control. For example, a processor can be included with or in the system 200 to control the components and functions of the system 200 described herein using software, firmware, hardware (e.g., fixed logic circuitry), manual processing, or a combination thereof. In the case of a software implementation, the module, functionality, or logic represents program code that performs specified tasks when executed on a processor (e.g., central processing unit (CPU) or CPUs). The program code can be stored in one or more computer-readable memory devices (e.g., internal memory and/or one or more tangible media), and so on. The structures, functions, approaches, and techniques described herein can be implemented on a variety of commercial computing platforms having a variety of processors.

A processor provides processing functionality for the system 200 and can include any number of processors, micro-controllers, or other processing systems, and resident or external memory for storing data and other information accessed or generated by the system 200. The processor can execute one or more software programs that implement techniques described herein. The processor is not limited by the materials from which it is formed or the processing mechanisms employed therein and, as such, can be implemented via semiconductor(s) and/or transistors (e.g., using electronic integrated circuit (IC) components), and so forth.

The system 200 also includes one or more computer memory devices. The memory is an example of tangible, computer-readable storage medium that provides storage functionality to store various data associated with operation of the system 200, such as software programs and/or code segments, or other data to instruct the processor, and possibly other components of the system 200, to perform the functionality described herein. Thus, the memory can store data, such as a program of instructions for operating the system 200 (including its components), and so forth. It is noted that while a single memory is shown, a wide variety of types and combinations of memory (e.g., tangible, non-transitory memory) can be employed. The memory can be integral with the processor, can comprise stand-alone memory, or can be a combination of both. The memory can include, but is not necessarily limited to: removable and non-removable memory components, such as random-access memory (RAM), read-only memory (ROM), flash memory (e.g., a secure digital (SD) memory card, a mini-SD memory card, and/or a micro-SD memory card), magnetic memory, optical memory, universal serial bus (USB) memory devices, hard disk memory, external memory, and so forth. In implementations, the system 200 and/or the memory can include removable integrated circuit card (ICC) memory, such as memory provided by a subscriber identity module (SIM) card, a universal subscriber identity module (USIM) card, a universal integrated circuit card (UICC), and so on.

The system 200 includes a communications interface. The communications interface is operatively configured to communicate with components of the system 200. For example, the communications interface can be configured to transmit data for storage in the system 200, retrieve data from storage in the system 200, and so forth. The communications interface is also communicatively coupled with the processor to facilitate data transfer between components of the system 200 and the processor (e.g., for communicating inputs to the processor received from a device communicatively coupled with the system 200 and/or communicating output to a device communicatively coupled with the system 200). It is noted that while the communications interface is described as a component of a system 200, one or more components of the communications interface can be implemented as external components communicatively coupled to the system 200 via a wired and/or wireless connection. The system 200 can also comprise and/or connect to one or more input/output (I/O) devices (e.g., via the communications interface) including, but not necessarily limited to: a display, a mouse, and so on.

The communications interface and/or the processor can be configured to communicate with a variety of different networks including, but not necessarily limited to: a wide-area cellular telephone network, such as a 3G cellular network, a 4G cellular network, a 5G cellular network, or a global system for mobile communications (GSM) network; a wireless computer communications network, such as a WiFi network (e.g., a wireless local area network (WLAN) operated using IEEE 802.11 network standards); an internet; the Internet; a wide area network (WAN); a local area network (LAN); a personal area network (PAN) (e.g., a wireless personal area network (WPAN) operated using IEEE 802.15 network standards); a public telephone network; an extranet; an intranet; and so on. However, this list is provided by way of example only and is not meant to limit the present disclosure. Further, the communications interface can be configured to communicate with a single network or multiple networks across different access points.

While the subject matter has been described in language specific to structural features and/or process operations, it is to be understood that the subject matter defined in the appended claims is not necessarily limited to the specific features or acts described above. Rather, the specific features and acts described above are disclosed as example forms of implementing the claims.

What is claimed is:

1. A method of monitoring a train consist comprising:

analyzing the train consist with a physics-based dynamic force model to determine whether the train consist would experience at least one of in-train force imbalances or lateral force imbalances indicative of at least one of a component malfunction or a derailment scenario for a proposed train route;

validating the train consist when it is determined that the train consist would not experience in-train force imbalances indicative of at least one of a component malfunction or a derailment scenario for the proposed train route;

detecting a change in the train consist following travel along at least a portion of the proposed train route via receipt of a work event alert from a train management system indicating a work event occurred for the train consist to provide an updated train consist, the change in the train consist including a change in at least one of an addition of a railway vehicle to the train consist, a removal of a railway vehicle from the train consist, or a change in an order of railway vehicles in the train consist;

responsive to receipt of the work event alert, analyzing the updated train consist with the physics-based dynamic force model to determine whether the updated train consist would experience in-train force imbalances indicative of at least one of a component malfunction or a derailment scenario for the proposed train route; and validating the updated train consist when it is determined that the updated train consist would not experience in-train force imbalances indicative of at least one of a component malfunction or a derailment scenario for the proposed train route.

2. The method of claim 1, further comprising:

selecting the proposed train route by selecting a departure location, a destination location, and a route of railroad track connecting the departure location and the destination location.

3. The method of claim 1, where the proposed train route is selected by selecting a departure location and a destination location, analyzing a plurality of routes of railroad track that connect the departure location and the destination location, and ranking routes of the plurality of routes of railroad track that connect the departure location and the destination location according to one or more metrics.

4. The method of claim 3, wherein the one or more metrics include one or more of duration of time spent on the route, distance of the route, and fuel efficiency of the train consist on the route.

5. The method of claim 1, further comprising:

receiving data associated with the proposed train route for analysis by the physics-based dynamic force model, the data including one or more of geographical locations of railway track curves, geographical locations of grade changes in the railway track, geographical locations of detours in the railway track, and geographical locations of speed limits along the railway track.

6. The method of claim 1, further comprising:

designing the train consist by selecting, via a user interface, a plurality of train components individually from a list of train components.

7. The method of claim 1, wherein the train consist is selected based on a consist of a train currently on railroad track.

8. The method of claim 1, wherein the train consist is selected based on a historical consist of a train on a prior travel route.

9. The method of claim 1, further comprising:

receiving data corresponding to individual railcar elements of the train consist for analysis by the physics-based dynamic force model, the data including one or more of weight of the railcar, physical dimensions of the railcar, and position of the railcar in the train consist.

10. The method of claim 1, further comprising:

generating an alert if it is determined that the updated train consist would experience in-train force imbalances indicative of at least one of a component malfunction or a derailment scenario for the proposed train route.

11. The method of claim 1, wherein analyzing a train consist with a physics-based dynamic force model includes determining, via the physics-based dynamic force model, whether the train consist would experience an in-train force or a lateral force that would exceed a predetermined force threshold along the proposed train route.

12. The method of claim 11, wherein the predetermined force threshold is a user-specified value received via a user interface.

13. The method of claim 1, wherein the work event further includes information associated with at least one of an addition of a physical load to the train consist or a removal of a physical load from the train consist.

14. A method of monitoring a train consist comprising:

designing an original train consist;

running a simulation of the original train consist along a selected travel route;

analyzing if the simulation meets a minimum safety margin based on potential in-train force imbalance analytics;

notifying a user if the original train build consist is forecasted to have component malfunctions due to the potential in-train force imbalance analytics;

validating the original train consist build when the train consist is determined to meet the minimum safety margin during travel along the travel route;

receiving a work event alert from a train management system indicating that a work event occurred for the train consist following travel along at least a portion of the proposed train route, the work event indicative of at least one of an addition of a railway vehicle to the train consist, a removal of a railway vehicle from the train consist, or a change in an order of railway vehicles in the train consist;

responsive to receipt of the work event alert, updating the original train consist to an updated train consist based on the work event;

running a simulation of the updated train consist along a remainder of the selected travel route; and validating the updated train consist when the updated train consist is determined to meet the minimum safety margin.

* * * * *